United States Patent [19]

Aitken et al.

[11] Patent Number: 4,998,492

[45] Date of Patent: Mar. 12, 1991

[54] METHOD OF AND APPARATUS FOR REDUCING PUCKERING OCCURRING IN A LINE OF MACHINE STITCHING DURING THE STITCHING OPERATION

[75] Inventors: John Aitken; John Fletcher, both of Paisley, Scotland

[73] Assignee: J. & P. Coats, Limited, Scotland

[21] Appl. No.: 438,400

[22] PCT Filed: Apr. 24, 1989

[86] PCT No.: PCT/GB89/00435

§ 371 Date: Dec. 28, 1989

§ 102(e) Date: Dec. 28, 1989

[87] PCT Pub. No.: WO89/10442

PCT Pub. Date: Nov. 2, 1989

[30] Foreign Application Priority Data

Apr. 29, 1988 [GB] United Kingdom ..... 8810313

[51] Int. Cl.[5] ..... D05B 27/00; D05B 47/00; D05B 35/08; D05B 47/00

[52] U.S. Cl. ..... 112/303; 112/121.13; 112/154; 112/148; 112/235; 112/450

[58] Field of Search ..... 112/121.13, 154, 148, 112/227, 235, 254, 278, 273, 281, 303, 322, 302, 450

[56] References Cited

U.S. PATENT DOCUMENTS

| | | | |
|---|---|---|---|
| 789,220 | 5/1905 | Krag | 112/179 |
| 919,706 | 4/1909 | Eichorn | 112/179 |
| 2,014,687 | 9/1935 | Lutz | 112/154 |
| 2,580,724 | 1/1952 | Bramfitt | 112/154 |
| 3,130,696 | 4/1964 | Ainslie | 112/254 |
| 3,194,195 | 7/1965 | Kremer | 112/154 |
| 3,534,695 | 10/1970 | Oram | 112/154 |
| 4,244,312 | 1/1981 | Bialy | 112/179 X |
| 4,590,878 | 5/1986 | Conti | 112/154 X |

FOREIGN PATENT DOCUMENTS

| | | | |
|---|---|---|---|
| 1241688 | 6/1967 | Fed. Rep. of Germany | 112/154 |

*Primary Examiner*—Werner H. Schroeder
*Assistant Examiner*—Ismael Izaguirre

[57] ABSTRACT

Apparatus is provided for forming on a work piece a line of stitching substantially free from puckering by placing a stitch-engaging element of a width less than the length of a stitch to project across the line of stitching at the sewing position. The stitch-engaging element comprises a plurality of flexible filamentary elements arranged side by side in close juxtaposition and an endless row of stitching-engaging elements movable in a direction longitudinally of the row of stitch-engaging elements and positioned so that a portion of the row of stitching-engaging elements projects across the line of stitching at the sewing position. The flexible filamentary elements project radially from the periphery of a disc to form an endless row of stitch-engaging elements.

8 Claims, 2 Drawing Sheets

METHOD OF AND APPARATUS FOR REDUCING PUCKERING OCCURRING IN A LINE OF MACHINE STITCHING DURING THE STITCHING OPERATION

BACKGROUND OF THE INVENTION

1. Field of the Invention

The subject of this invention is a method and apparatus to reduce puckering in machine sewn seams.

It is known to form on a work piece a line of machine stitching substantially free from puckering by placing a stitch-engaging element of a width less than the length of a stitch to project across the line of stitching in advance of the sewing position, allowing the element to remain in position across the line of stitching until a stitch has been formed overlying the element then withdrawing the element from below the formed stitch.

All the known apparatus intended to reduce or eliminate puckering has incorporated a stitch-engaging element in the form of a rigid finger operatively connected to the sewing machine mechanism and synchronized therewith to move transversely across the line of stitching immediately before each stitch is formed and then to be withdrawn from below the formed stitch immediately after the stitch is formed.

Such known apparatus has either to be built into the machine during manufacture of the machine or if it is to be fitted to an existing machine extensive modification of the machine is required to adapt it to receive the stitch-engaging element and its operating mechanism.

SUMMARY OF THE INVENTION

It is an object of the present invention to provide a simple method of and apparatus for reducing puckering in seams which can be readily fitted to any existing sewing machine and which does not normally require to be linked in any way with the machine mechanism.

According to the invention apparatus for forming on a work piece a line of stitching substantially free from puckering by placing a stitch-engaging element of a width less than the length of a stitch to project across the line of stitching at the sewing position is characterized by employing as the stitch-engaging element a number of flexible filamentary elements arranged side by side in close juxtaposition as an endless row of stitch-engaging elements movable in a direction longitudinally of the row of stitch-engaging elements and positioned so that a portion of the row of stitch-engaging elements projects permanently across the line of stitching at the sewing position.

The apparatus defined above may include a disc presenting flexible filamentary elements projecting radially from the periphery of the disc completely around the periphery of the disc to form an endless row of stitch-engaging elements, said disc being rotatable about an axis arranged to be located to one side of the line of stitching adjacent to the sewing position such that at least one element constituting a portion of said endless row always projects across the line of stitching at the sewing position.

The portion of the row of stitch-engaging elements projecting permanently across the line of stitching may comprise several stitching elements covering a portion of the line of stitching from a point in advance of the needle of a sewing machine to a point at the rear of the needle.

The disc may be flat or dished.

Alternatively the apparatus may be constituted by a wheel having a coned rim from the larger diameter end of which flexible stitch-engaging elements disposed around the periphery of the rim project, the elements being orientated to lie on the surface of an imaginary right cone the axis of which is coincident with the axis of the wheel, the wheel being rotatable about an axis inclined with respect to the surface on which the work to be stitched lies during stitching, the angle of inclination of said axis being such that there is always at least one stitch-engaging element adjacent the work surface and projecting across the line of stitching to be formed in advance of the needle position.

The stitch-engaging elements may be attached to an endless band wrapping two spaced freely rotatable pulleys. Alternatively the stitch-engaging elements may be attached to a free endless band guided to traverse the sewing position.

The flexible filamentary elements may be filaments of a synthetic material such as nylon.

The disc or the wheel or band carrying the stitch-engaging elements may be freely rotatable or freely movable or if specially desired may be arranged to be driven by the machine mechanism, for example the disc or the wheel may be fixed to a spindle operatively engageable with a projection on the needle bar of the associated sewing machine such that reciprocation of the needle bar imparts intermittent rotary motion to the disc or the wheel.

The disc or the wheel may be mounted on a pin supported by a frame arranged to be clamped to a conveniently located portion of a sewing machine frame.

BRIEF DESCRIPTION OF THE DRAWINGS

Practical embodiments of the invention are illustrated in the accompanying drawings in which there is illustrated in FIG. 1 apparatus incorporating a flat disc, in FIG. 2 apparatus incorporating a coned wheel, in FIG. 3 apparatus incorporating a band including two guide pulleys and in FIG. 4 apparatus incorporating a band guided to traverse the sewing position but otherwise unsupported and unguided.

DESCRIPTION OF PREFERRED EMBODIMENTS

Figure 1:
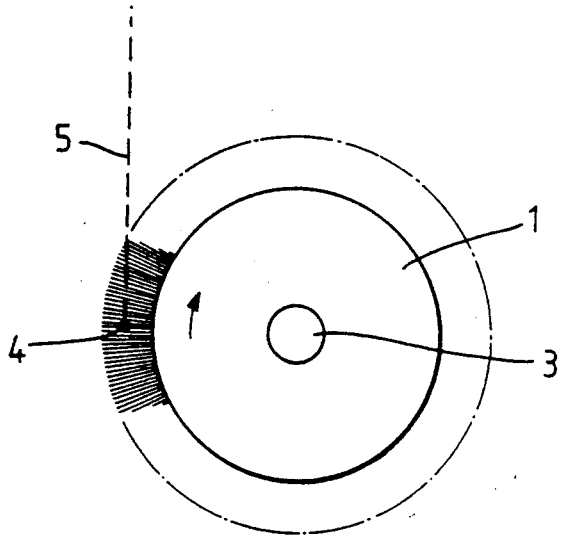
Figure 2:
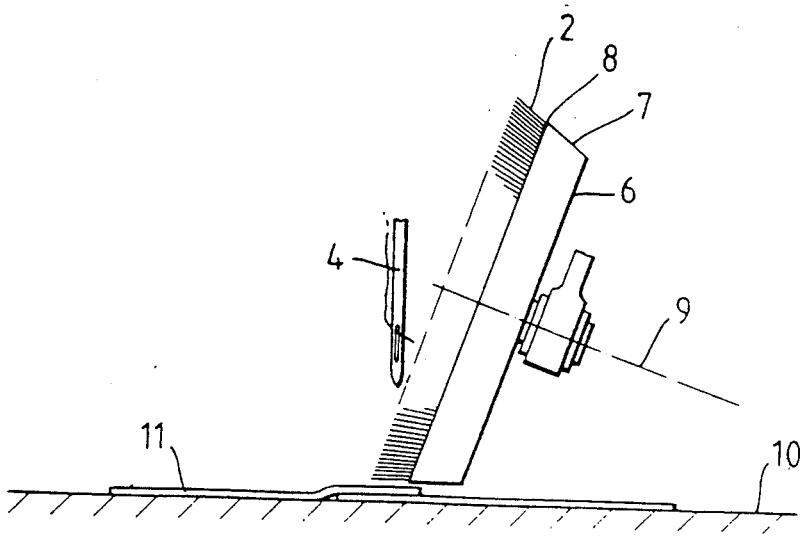
Figure 3:
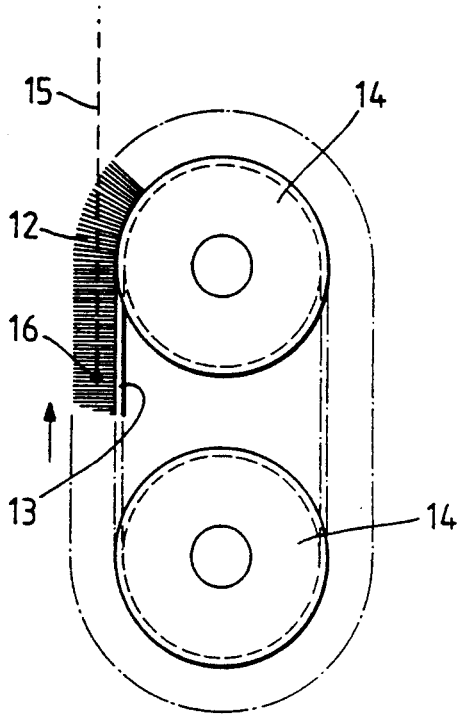
Figure 4:
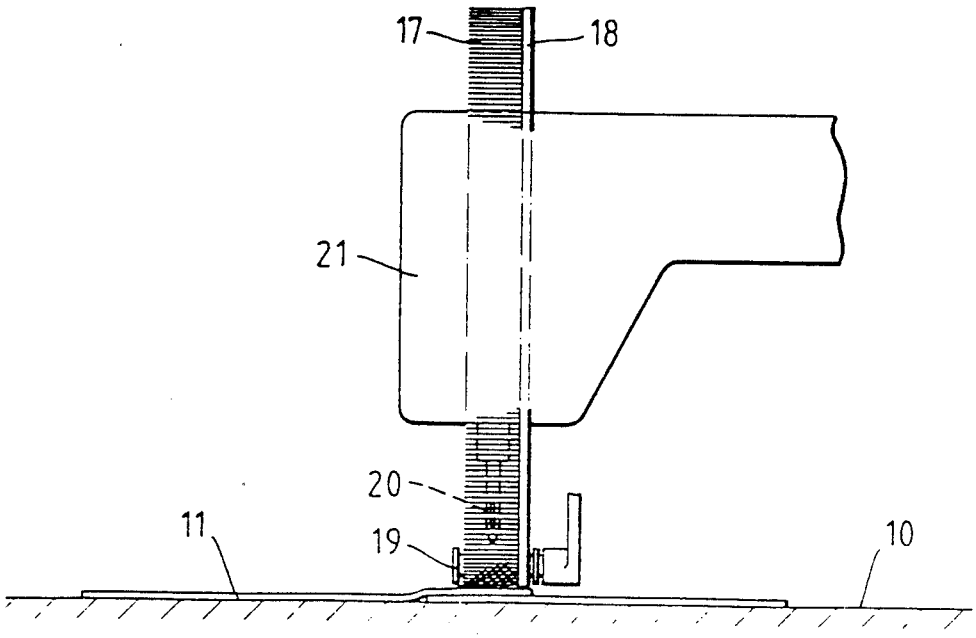

In the drawings, in FIG. 1, 1 denotes a disc from the periphery of which radially extending stitch-engaging elements 2 formed of filaments of a flexible material project. The disc 1 is freely mounted on a pivot 3 supported by the sewing machine frame. 4 denotes the needle of an associated sewing machine and 5 denotes a line of stitches already formed by the needle 3. In FIG. 2, 6 denotes a wheel the periphery 7 of which is formed as a portion of a cone from the larger diameter end 8 of which there project the stitch-engaging elements 2, the wheel 6 being rotatable around its axis 9 inclined to the work surface 10 of the sewing machine at an angle such that the stitch-engaging elements adjacent to the work surface are substantially parallel to the work surface. 11 denotes a work piece being sewn by the action of the needle 4. In FIG. 3, 12 denotes a row of flexible stitch-engaging elements lying side by side and projecting from an endless band 13 wrapping two freely rotatable pulleys 14. The stitch-engaging elements all lie in the one plane and the pulleys are so placed on the machine that a portion of one flight of the row of stitch-engaging elements projects across the line of stitching 15 from a position in advance of the needle 16 to a position to the rear of the needle 16. In FIG. 4, 17 denotes flexible stitch-engaging elements arranged in side by side relationship in a row formed as a loop 18 a portion of which is guided by a guiding device 19 to project across the line of stitching from a point in advance of the needle 20 to a point to the rear of the needle 20, the rest of the loop freely encircling the sewing machine portion 21.

In operation of the invention and with particular reference to the embodiments illustrated in FIGS. 1 and 2 of the drawings, as the work piece 11 is fed towards the needle 4 in the action of forming a line of stitches on the material 11 the disc 1 (FIG. 1) or the wheel 6 (FIG. 2) rotates because the stitch-engaging elements 2 projecting across the line of stitching are pressed against the work piece 11 by the presser foot of the sewing machine and are carried along by the moving work piece 11. As each element 2 passes below the needle a stitch is formed over that element 2. According to the length of the stitch and the spacing of the elements 2 several such elements may be overlaid by the same stitch. Continued rotation of the disc 1 or the wheel 6 during continued feeding of the work piece 11 causes the elements 2 which have passed the sewing position of the needle 3 to be withdrawn from below the line of formed stitches 5 thus leaving a minute gap below each stitch. The embodiments of FIGS. 3 and 4 operate in exactly the same manner as the embodiments of FIGS. 1 and 2 except that the bands 13 and 18 circulate as sewing proceeds.

The use of a multiplicity of flexible stitch-engaging elements movable by the usual feeding movement of the material being sewn during the sewing operation and the arrangement that only a fraction of the total number of stitch-engaging elements is continuously movable across and withdrawn from the line of stitching by change of direction of the stitch-forming elements in advance of and to the rear of the position where the needle forms the stitches completely eliminates any need to synchronize the anti-puckering device with the machine mechanism.

Pucker of a seam frequently occurs either because of incorrectly set tension in the thread being sewn or shrinkage of the thread subsequent to the sewing operation and the existence of said gap ensures that there is sufficient thread in each stitch to compensate for incorrectly set tension or any shrinkage which does occur. It has been found that this minute gap does not impair in any way the strength of the seam or alter the seam balance or its appearance but eliminates entirely or almost entirely any tendency to form puckers in the seam.

It should be understood that where the tension is correctly set and there is no after shrinkage performance of the method of the invention does not produce any deleterious effect in sewn seams.

We claim:

1. Apparatus for forming on a work piece a line of stitching substantially free from puckering by placing a stitch-engaging element of a width less than the length of a stitch to project across the line of stitching at the sewing position of a sewing machine having a needle said stitch-engaging element comprising a number of flexible filamentary elements arranged side by side in close juxtaposition as an endless row of stitch-engaging elements movable in a direction longitudinally of the row of stitch-engaging elements and positioned so that a portion of the row of stitch-engaging elements projects across the line of stitching at the sewing position.

2. Apparatus as claimed in claim 1, incorporating a disc presenting said flexible filamentary elements projecting radially from the periphery of the disc to form an endless row of stitch-engaging elements, said disc being rotatable about an axis arranged to be located to one side of the line of stitching adjacent to the sewing position such that at least one element constituting a portion of said endless row always projects across the line of stitching at the sewing position.

3. Apparatus as claimed in claim 2, wherein said disc is constituted by a wheel having a coned rim, from the larger diameter end project said flexible stitch-engaging elements disposed around the periphery of the rim, said elements being oriented to lie on a surface of an imaginary right cone, said cone having an axis coincident with the axis of the wheel, said wheel being rotatable about an axis inclined with respect to the surface on which the work to be stitched, the angle of inclination of said axis being such that there is always at least one stitch-engaging element adjacent the work surface and projecting across the line of stitching to be formed in advance of the needle position.

4. Apparatus as claimed in claim 1, wherein the portion of the row of said stitch-engaging elements projecting across the line of stitching comprises several stitching elements arranged to cover a portion of the line of stitching from a point in advance of the needle of said sewing machine to a rear point of the needle.

5. Apparatus as claimed in claim 1, wherein said stitch-engaging elements are attached to an endless band wrapping two spaced freely rotatable pulleys.

6. Apparatus as claimed in claim 1, wherein said stitch-engaging elements are attached to a free endless band guided to traverse the sewing position.

7. Apparatus as claimed in claim 1, wherein said stitch-engaging elements are freely movable.

8. Apparatus according to claim 1, wherein the stitch-engaging elements are arranged for connection to the sewing machine to be driven thereby.

* * * * *